US006706936B2

(12) United States Patent
O'Rear et al.

(10) Patent No.: US 6,706,936 B2
(45) **Date of Patent: *Mar. 16, 2004**

(54) PROCESS FOR MAKING A LUBE BASE STOCK FROM A LOWER MOLECULAR WEIGHT FEEDSTOCK

(75) Inventors: Dennis J. O'Rear, Petaluma, CA (US); Thomas V. Harris, Benicia, CA (US); Stephen J. Miller, San Francisco, CA (US); Russell R. Krug, Novato, CA (US); Brent K. Lok, San Francisco, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 165 days.

This patent is subject to a terminal disclaimer.

(21) Appl. No.: 09/758,813

(22) Filed: Jan. 11, 2001

(65) Prior Publication Data

US 2002/0003102 A1 Jan. 10, 2002

Related U.S. Application Data

(63) Continuation-in-part of application No. 09/470,053, filed on Dec. 22, 1999, now Pat. No. 6,398,946.

(51) Int. Cl.[7] ..... C07C 2/04; C01M 101/02

(52) U.S. Cl. ..... 585/330; 585/324; 585/326; 585/329; 585/518; 585/519; 585/520; 585/616; 208/18

(58) Field of Search ..... 208/18, 58, 71, 208/93; 585/326, 329, 330, 506, 508, 256, 324, 518, 519, 520, 601, 603, 616, 638

(56) References Cited

U.S. PATENT DOCUMENTS

| | | | | |
|---|---|---|---|---|
| 3,852,207 A | | 12/1974 | Stangeland et al. | |
| 3,904,513 A | | 9/1975 | Fischer et al. | |
| 4,157,294 A | | 6/1979 | Iwao et al. | |
| 4,232,177 A | | 11/1980 | Smith, Jr. | |
| 4,307,254 A | | 12/1981 | Smith, Jr. | |
| 4,308,414 A | * | 12/1981 | Madgavkar et al. | 585/525 |
| 4,336,407 A | | 6/1982 | Smith, Jr. | |
| 4,401,556 A | | 8/1983 | Bezman et al. | |
| 4,413,153 A | * | 11/1983 | Garwood et al. | 585/304 |
| 4,417,088 A | | 11/1983 | Miller | 585/533 |
| 4,484,014 A | * | 11/1984 | Nelson et al. | 585/255 |
| 4,523,045 A | | 6/1985 | Vora | |
| 4,523,048 A | | 6/1985 | Vora | |
| 4,527,004 A | * | 7/1985 | Sweeney | 585/851 |
| 4,542,247 A | * | 9/1985 | Chang et al. | 585/254 |
| 4,542,251 A | | 9/1985 | Miller | 585/533 |
| 4,608,450 A | | 8/1986 | Miller | |
| 4,657,661 A | | 4/1987 | Miller | |
| 4,678,645 A | | 7/1987 | Chang et al. | 422/190 |
| 4,820,402 A | | 4/1989 | Partridge et al. | |
| 4,855,524 A | | 8/1989 | Harandi et al. | 585/517 |
| 4,913,799 A | | 4/1990 | Gortsema et al. | |
| 4,935,577 A | * | 6/1990 | Huss, Jr. et al. | 585/726 |
| 4,962,249 A | | 10/1990 | Chen et al. | 585/329 |
| 5,004,862 A | * | 4/1991 | Hildinger et al. | 585/867 |
| 5,012,021 A | | 4/1991 | Vora et al. | |
| 5,015,361 A | | 5/1991 | Anthes et al. | 208/111 |
| 5,037,528 A | * | 8/1991 | Garwood et al. | 208/27 |
| 5,049,536 A | | 9/1991 | Bellussi et al. | 502/235 |
| 5,059,567 A | | 10/1991 | Linsten et al. | |
| 5,068,476 A | * | 11/1991 | Wu et al. | 585/12 |
| 5,073,530 A | | 12/1991 | Bezman et al. | |
| 5,080,878 A | | 1/1992 | Bowes et al. | 423/328 |
| 5,082,986 A | | 1/1992 | Miller | 585/667 |
| 5,114,563 A | | 5/1992 | Lok et al. | |
| 5,135,638 A | | 8/1992 | Miller | 208/27 |
| 5,146,022 A | | 9/1992 | Buchanan et al. | 585/12 |
| 5,171,909 A | | 12/1992 | Sanderson et al. | 585/255 |
| 5,198,203 A | | 3/1993 | Kresge et al. | |
| 5,198,597 A | | 3/1993 | O'Young et al. | |
| 5,243,112 A | | 9/1993 | Chester et al. | 585/12 |
| 5,246,566 A | | 9/1993 | Miller | 208/27 |
| 5,246,689 A | | 9/1993 | Beck et al. | |
| 5,270,273 A | | 12/1993 | Pelrine et al. | 502/60 |
| 5,276,229 A | | 1/1994 | Buchanan et al. | 585/255 |

(List continued on next page.)

FOREIGN PATENT DOCUMENTS

| | | |
|---|---|---|
| EP | 225 053 B1 | 10/1986 |
| EP | 464 546 B1 | 6/1991 |
| EP | 582 347 B1 | 7/1993 |
| EP | 659 478 B1 | 12/1994 |
| EP | 791 643 A1 | 2/1997 |
| WO | WO 96/13563 | 10/1994 |
| WO | WO 96/26993 | 12/1995 |

OTHER PUBLICATIONS

Dornte, R. W., *Oxidation of White Oils, Industrial and Engineering Chemistry*, Industrial Edition, Jan., 1936, vol. 28, No. 1, Published by American Chemical Society, Easton, PA. pp. 26–30.

Endeby, J. E., "Ionic liquids: recent progress and remaining problems", *J. Phys. Condensed Matter*, vol. 5, Supp.34B, pp. B99–B106, Institute of Physics Publishing, U.K (1993).

Malz Jr., Richard, "Catalysis of Organic Reactions", 68, pp 249–263, Marcel Dekker, Inc., New York, (1996).

Seddon, K. R., "Ionic Liquids for Clean Technology", *J.Chem. Tech.Biotechnol.*, 68: 351–356, John Wiley & Sons Ltd., UK. (1997).

*Primary Examiner*—Walter D. Griffin
(74) *Attorney, Agent, or Firm*—Burns, Doane, Swecker & Mathis, L.L.P.

(57) ABSTRACT

A process for making a lube base stock wherein a highly paraffinic feedstock is dehydrogenated to produce an olefinic feedstock. That olefinic feedstock is contacted with an oligomerization catalyst in an oligomerization zone to produce a product having a higher number average molecular weight than the olefinic feedstock. The product is separated into a light byproduct fraction and a heavy product fraction. The heavy product fraction comprises a lube base stock.

24 Claims, 4 Drawing Sheets

U.S. PATENT DOCUMENTS

| | | | | | |
|---|---|---|---|---|---|
| 5,282,958 | A | | 2/1994 | Santilli et al. | 208/111 |
| 5,334,368 | A | | 8/1994 | Beck et al. | |
| 5,382,739 | A | * | 1/1995 | Atkins et al. | 585/530 |
| 5,453,556 | A | | 9/1995 | Chang et al. | 585/524 |
| 5,502,018 | A | | 3/1996 | Chauvin et al. | |
| 5,550,304 | A | | 8/1996 | Chauvin et al. | |
| 5,723,716 | A | | 3/1998 | Brandes et al. | 585/734 |
| 5,741,759 | A | | 4/1998 | Gee et al. | |
| 5,866,746 | A | | 2/1999 | Didillion et al. | |
| 5,965,783 | A | | 10/1999 | Gee et al. | |
| 6,008,164 | A | | 12/1999 | Aldrich et al. | 508/110 |
| 6,025,533 | A | | 2/2000 | Vora et al. | 585/330 |
| 6,518,473 | B2 | * | 2/2003 | Miller et al. | 585/517 |

* cited by examiner

PROCESS FOR MAKING A LUBE BASE STOCK FROM A LOWER MOLECULAR WEIGHT FEEDSTOCK

This application is a continuation-in-part of U.S. Ser. No. 09/470,053, filed Dec. 22, 1999, now U.S. Pat. No. 6,398,946, titled "A Process For Making A Lube Base Stock From A Lower Molecular Weight Feedstock," and is also related to two applications filed concurrently with this application, with the titles "A Process For Making A Lube Base Stock From A Lower Molecular Weight Feedstock Using At Least Two Oligomerization Zones" and "A Process For Making A Lube Base Stock From A Lower Molecular Weight Feedstock In A Catalytic Distillation Unit."

The present invention relates to a process for making a lube base stock from materials having lower molecular weights. Included in this invention is a process for making predominately bright stock lube base stock.

BACKGROUND OF THE INVENTION

Lubricant oils of high viscosity and high oxidation stability are desirable. Such materials have been prepared, for example, by hydrocracking, hydrodewaxing and hydrofinishing various petroleum feedstocks and by polymerizing normal alpha olefins such as 1-decene. The former route has the advantage of moderate costs, but the oxidation stability is not exceptional. As attempts are made to improve the oxidation stability by increasing the severity of the hydroprocessing steps, the yield of lube declines, as does its viscosity. The latter route gives an exceptionally stable product, but suffers the disadvantage of high cost.

It would be desirable to provide a moderate cost process that generates high viscosity and highly stable products. The present invention provides such a process.

U.S. Pat. No. 6,025,533 to Vora, et al. ("Oligomer Production with Catalytic Distillation") teaches production of heavy oligomers ($C_7$+oligomers) from $C_4$ paraffins and olefins by a combination of dehydrogenation and oligomerization. The process has at least one catalyst bed in the top of a distillation column for separating the oligomerization effluent of the dehydrogenation and oligomerization combination.

U.S. Pat. No. 5,276,229 to Buchanan, et al. ("High VI Synthetic Lubricants From Thermally Cracked Slack Wax") teaches oligomerizing alpha-olefins produced from thermal cracked slack wax.

U.S. Pat. No. 5,015,361 to Anthes, et al. ("Catalytic Dewaxing Process Employing Surface Acidity Deactivated Zeolite Catalysts") teaches oligomerization of propylene in two stages using ZSM-23 and ZSM-5 to form a low pour point, high cloud point product, followed by dewaxing.

U.S. Pat. No. 4,855,524 to Harandi, et al. ("Process For Combining The Operation of Oligomerization Reactors Containing a Zeolite Oligomerization Catalyst") teaches combining the operation of a primary reactor that oligomerizes a $C_{3-7}$ feed to gasoline range hydrocarbons and a high pressure secondary reactor that oligomerizes the effluent of the first reactor to make distillate or lubes.

U.S. Pat. No. 4,678,645 to Chang, et al. ("Conversion of LPG Hydrocarbons to Distillate Fuels or Lubes Using Integration of LPG Dehydrogenation and MOGDL") teaches converting $C_4$− paraffins to higher hydrocarbons by the combination of catalytic or thermal dehydrogenation of a paraffinic feedstock to produce olefins and conversion of olefins to gasoline and distillate boiling range materials in a low pressure oligomerization catalytic reactor and a high pressure oligomerization catalytic reactor.

A variety of patents disclose catalysts useful for oligomerization.

U.S. Pat. No. 5,453,556 to Chang et al. Oligomerization Process For Producing Synthetic Lubricants") teaches an oligomerization process using a catalyst having an acidic solid with a Group IVB metal oxide modified with an oxyanion of a Group VIB metal.

U.S. Pat. No. 5,270,273 to Pelrine et al. ("Olefin Oligomerization Catalyst") teaches an olefin oligomerization catalyst having a supported, reduced Group VIB metal oxide on an inorganic support, such as MCM-41.

U.S. Pat. No. 5,243,112 to Chester, et al. ("Lubricant Range Hydrocarbons From Light Olefins") teaches oligomerizing an olefinic feedstock over a medium pore zeolite catalyst (HZSM-22).

U.S. Pat. No. 5,171,909 to Sanderson, et al. ("Synthetic Lubricant Base Stocks From Long-Chain Vinylidene Olefins and Long-Chain Alpha- and/or Internal-Olefins") teaches oligomerization of long-chain olefins using certain acidic montmorillonite clay catalysts.

U.S. Pat. No. 5,146,022 to Buchanan et al ("High VI Synthetic Lubricants From Cracked Slack Wax") teaches oligomerizing with a Lewis acid catalyst a mixture of $C_5$–$C_{18}$ or $C_6$–$C_{16}$ alpha-olefins produced from thermal cracking of slack wax.

U.S. Pat. No. 5,080,878 to Bowes, et al. ("Modified Crystalline Aluminosilicate Zeolite Catalyst and Its Use in the Production of Lubes of High Viscosity Index") teaches oligomerization with a modified zeolite (ZSM-5, ZSM-11, ZSM-12, ZSM-22, ZSM-23, ZSM-35, ZSM-38, or ZSM-48).

U.S. Pat. No. 4,962,249 to Chen, et al. ("High VI Lubricants From Lower Alkene Oligomers") teaches oligomerization of lower olefins with a reduced valence state Group VIB metal oxide on porous support. In one embodiment, a feedstock of lower olefins is contacted with surface deactivated, acidic, medium pore, shape selective metallosilicate catalyst under oligomerization conditions, then reacting the mixture with ethylene in contact with an olefin metathesis catalyst under metathesis conditions, then oligomerizing the metathesis product in contact with a reduced valence state Group VIB metal catalyst on porous support.

U.S. Pat. No. 4,542,251 to Miller ("Oligomerization of Liquid Olefin Over a Nickel-Containing Silicaceous Crystalline Molecular Sieve") teaches oligomerization in the liquid phase using nickel-containing silicaceous crystalline molecular sieve catalysts to produce lube base stock.

U.S. Pat. No. 4,417,088 to Miller ("Oligomerization of Liquid Olefins") teaches oligomerization of liquid olefins using intermediate pore size molecular sieves to produce lube base stock.

EP 791,643 A1 ("Lubricating Oils") teaches a process for the production of lubricating oils having a viscosity index of at least 120 and a pour point of −45 C. or less by oligomerizing a feedstock comprising one or more $C_{5-18}$ 1-olefins in the presence of an oligomerization catalyst comprising an ionic liquid.

In conventional hydrodewaxing, the pour point is lowered by selectively cracking the longer chain wax molecules, mostly normal and slightly branched paraffins. A disadvantage associated with catalytic dewaxing is that the wax is degraded to lower molecular weight materials. For example, waxy paraffins may be cracked down to butane, propane, ethane and methane and so may branched paraffins which do not contribute to the waxy nature of the oil. It is desirable to limit the degree of cracking which takes place during a catalytic dewaxing process, because these lighter products are generally of lower value than the higher molecular weight materials, and because the viscosity index and oxidation stability of the resulting oil is degraded by the loss of paraffins.

A major breakthrough came with the discovery of new dewaxing catalysts, which were found to isomerize rather than crack the wax molecules. Isomerization alters the molecular structure of wax molecules, and generally decreases the pour point of a molecule without significantly changing its boiling point. In contrast to wax cracking, isomerized molecules are retained in the lubricating oil base stock, increasing yield of lubricating oil base stock without reducing viscosity index or oxidation stability significantly.

U.S. Pat. No. 5,135,638 to Miller ("Wax Isomerization Using Catalyst of Specific Pore Geometry") discloses a process for producing lube oil from a feedstock having greater than 50% wax. The feedstock is isomerized over a catalyst comprising a molecular sieve (e.g., SAPO-11, SAPO-31, SAPO-41, ZSM-22, ZSM-23, and ZSM-35) and at least one Group VIII metal at a pressure of from about 15 psig to about 2000 psig.

U.S. Pat. No. 5,246,566 to Miller ("Wax Isomerization Using Catalyst of Specific Pore Geometry") discloses a process similar to that of U.S. Pat. No. 5,135,638, but where the waxy feed has a pour point of above about 0 C. and contains greater than about 70% paraffinic carbon.

U.S. Pat. No. 5,282,958 to Santilli, et al. ("Use of Modified 5–7 Å Molecular Sieves For Isomerization of Hydrocarbons") discloses isomerizing a feed including straight chain and slightly branched chain paraffins having 10 or more carbons using an intermediate pore size molecular sieve (e.g., SAPO-11, SAPO-31, SAPO-41, ZSM-22, ZSM-23, and ZSM-35). Feeds that may be processed by this method include waxy feeds, which contain greater than about 50% wax.

U.S. Pat. No. 5,082,986 to Miller ("Process for Producing Lube Oil From Olefins By Isomerization Over a Silicoaluminophosphate Catalyst") discloses a process for making a $C_{20}$+ lube oil from olefins or reducing the pour point of a lube oil comprising isomerizing the olefins over a catalyst an intermediate pore size silicoaluminophosphate molecular sieve and at least one Group VIII metal.

Large pore zeolites represent another class of catalysts that have been taught for wax isomerization.

EP 464,546 to Degnan et al. ("Production of high viscosity index lubricants") teaches producing a high viscosity index lubricant from a petroleum wax feed having a paraffin content of at least 40 weight percent. The catalyst is a low acidity zeolite isomerization catalyst having an alpha value of below 20. Zeolite Beta, which contains boron as a framework component of the zeolite, is taught as being preferred.

WO 96/26,993 to Apelian et al. ("Wax Hydroisomerization Process") teaches for producing a high viscosity index lubricant catalytically dewaxing waxy paraffins by isomerization in the presence of hydrogen and a low acidity large pore zeolite isomerization catalyst having a ratio of $SiO_2/Al_2O_3$, as synthesized, of at least 200:1.

WO 96/13,563 to Apelian et al. ("Wax Hydroisomerization Process") teaches an isomerization process for producing a high viscosity index lubricant using a low acidity large pore molecular sieve having a crystal size of less than 0.1 micron, an alpha value of not more than 30 and containing a noble metal hydrogenation component.

EP 225,053 to Garwood et al. ("Lubricant production process") teaches isomerization dewaxing using a large pore, high silica zeolite dewaxing catalyst, followed by a subsequent dewaxing step which selectively removes the more waxy n-paraffin components. The selective dewaxing step may be either a solvent or a catalyst dewaxing, preferably using a highly shape selective zeolite such as ZSM-22 or ZSM-23.

EP 659,478 to Perego et al. ("Process for preparing amorphous, catalytically active silico-sluminas") teaches a process for producing a high VI lubricant from a waxy hydrocarbon feed by isomerization in the presence of hydrogen and a low acidity large pore molecular sieve.

Non-zeolitic catalysts are also taught for wax isomerization.

U.S. Pat. No 5,049,536 to Belussi, et al. ("Catalytically Active Silica and Alumina Gel and Process For Preparing It") catalysts are described based on silica and alumina gel and their use in isomerization processes.

EP 582,347 to Perego et al. ("Catalyst for the hydroisomerization of long-chain N-paraffins and process for preparing it") teaches a bifunctional catalyst for hydroisomerization. That catalyst has at least one Group VIIIA noble metal on a calcined amorphous silica and alumina gel.

U.S. Pat. No. 5,723,716 to Brandes, et al. ("Method For Upgrading Waxy Feeds Using a Catalyst Comprising Mixed Powdered Dewaxing Catalyst and Powdered Isomerization Catalyst Formed Into A Discrete Particle (LA W082)") teaches combinations of zeolitic and non-zeolitic catalyst components.

U.S. Pat. No. 6,008,164 to Aldrich et al. ("Lubricant Base Oil Having Improved Oxidative Stability") teaches a method of producing a lube base stock by separating, into a plurality of fractions based on molecular shape, a hydroisomerized hydrocarbon wax, and collecting the fractions that have a preselected oxidative stability.

U.S. Pat. Nos. 4,417,088; 4,542,251; 4,678,645; 4,855,524; 4,962,249; 5,015,361; 5,049,536; 5,080,878; 5,082,986; 5,135,638; 5,146,022; 5,171,909; 5,243,112; 5,246,566; 5,270,273; 5,276,229; 5,282,958; 5,453,556; 5,723,716; 6,008,164; and 6,025,533 are hereby incorporated by reference for all purposes.

SUMMARY OF THE INVENTION

The present invention provides a process for forming hydrocarbons in the lube base stock range from a lower molecular weight feedstock. A highly paraffinic feedstock with boiling points greater than 180 F., preferably greater than 258 F., more preferably within the range of from 258 to 1100° F., most preferably within the range of from 258 to 650 F., and preferably including greater than 75% by weight paraffins, is obtained. Preferably, the highly paraffinic feedstock is purified to remove oxygenates and other impurities, for example, by hydrotreatment or by adsorption with an acid clay. Preferably, the highly paraffinic feedstock is dehydrated and decarboxylated to convert any alcohols or acids which may be present to olefins.

The paraffinic feedstock is dehydrogenated in a dehydrogenation zone to produce an olefinic feedstock that preferably includes less than 50% olefins by weight, more preferably between 10% and 50% olefins by weight, with the balance being predominantly paraffins. When paraffinic feedstocks are dehydrogenated, the dehydrogenation conditions can form undesired diolefins. Preferably, the olefinic feedstock is selectively hydrogenated to saturate at least a portion of any diolefins which may be present while retaining the monoolefins. Conditions for selective hydrogenation of diolefins in the presence of monoolefins are well known to those of skill in the art.

The olefinic feedstock is contacted with an oligomerization catalyst in an oligomerization zone to produce a product having a higher number average molecular weight than the olefinic feedstock. Preferably, the product from the oligomerization zone has a number average molecular weight at least 10% higher than the olefinic feedstock, more preferably at least 20% higher than the olefinic feedstock. Preferably, the oligomerization catalyst includes an inorganic oxide support, more preferably a Group VIII metal on an inorganic oxide support, most preferably a Group VIII metal on a zeolitic support. In one embodiment, the oligomerization catalyst is nickel on ZSM-5. In an alternative embodiment, the oligomerization catalyst comprises an ionic liquid, preferably an acidic ionic liquid.

In one embodiment, the oligomerization zone is located within a catalytic distillation unit used to both produce the product and separate the product into a light byproduct fraction and a heavy product fraction. In that embodiment, the olefinic feedstock can also be contacted with an oligomerization catalyst in a fixed bed prior to the catalytic distillation unit. Preferably, at least a portion of the light byproduct fraction is recycled either to the catalytic distillation unit or to the fixed bed or to both the catalytic distillation unit and the fixed bed.

The product from the oligomerization zone is separated into a light byproduct fraction and a heavy product fraction, where the heavy product fraction comprises lube base stock. The production of hydrocarbons in the lube base stock range can maximized by recycling substantially all of the light byproduct fraction, either to the dehydrogenation zone, to a cracking zone, or to a catalytic distillation zone. Preferably, at least a portion of the light byproduct fraction is recycled to the dehydrogenation zone. The paraffinic feedstock, olefinic feedstock, and/or final product can be subjected to skeletal isomerization to control the pour and cloud point of the final product. Skeletal isomerization can be induced at any of a number of points of the process, including (1) on the highly paraffinic feedstock, (2) during dehydrogenation, (3) on the olefinic feedstock (4) in the oligomerization zone, (5) on the product from the oligomerization zone, and/or (6) on the heavy product fraction. Preferably, skeletal isomerization is induced prior to the oligomerization zone. The product from the oligomerization zone or the heavy product is advantageously subjected to hydrofinishing conditions to reduce the olefin content.

The hydrocarbons in the lube base stock range produced by the process include predominantly paraffins and are free of aromatics. Since paraffins are less susceptible to oxidation than aromatics, the product has higher oxidation stability than aromatic-containing compositions.

Preferably, the heavy products fraction has a viscosity of greater than 2 cSt at 100° C., a viscosity index of at least 80 and a pour point of less than −10° C. More preferably, the viscosity index is at least 120 and a pour point of less than −20° C. More preferably, heavy products fraction is separated into at least one of the following fractions:

a) a light lube base stock fraction having a viscosity of from 2 to 7 cSt at 100° C.;

b) a heavy lube base stock fraction having a viscosity of from 6 to 20 cSt at 100° C.; and c) a bright stock fraction having a viscosity of greater than 180 cSt at 40° C.

In one embodiment, the highly paraffinic feedstock is derived, in whole or in part, from Fischer-Tropsch synthesis. Preferably, the product of the Fischer-Tropsch synthesis is separated into a light gas fraction, a middle fraction (which is heavier than the light gas fraction and which forms at least part of (preferably substantially all of) the highly paraffinic feedstock), and a wax fraction (which is heavier than the middle fraction).

In one embodiment, the wax fraction can be thermally cracked to provide olefins, rather than using paraffin dehydrogenation to provide olefins, and the resulting olefinic feedstock sent to the oligomerization zone. In another embodiment, a portion of the middle fraction and the entire wax fraction is thermally cracked to form an olefinic feedstock, and at least a portion of this feedstock is sent to the oligomerization zone.

BRIEF DESCRIPTION OF THE DRAWINGS

In order to assist the understanding of this invention, reference will now be made to the appended drawings. The drawings are exemplary only, and should not be construed as limiting the invention.

DETAILED DESCRIPTION OF THE INVENTION

Figure 1:
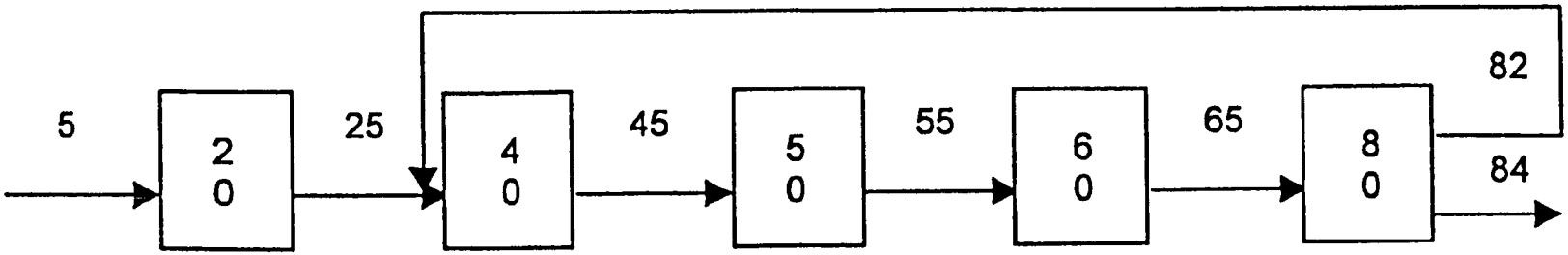
FIG. 1 shows a block diagram of a specific embodiment of a process for making a lube base stock from a lower molecular weight feedstock.

In its broadest aspect, the present invention involves a process for making a lube base stock or hydrocarbons in the lube base stock range from a highly paraffinic feedstock with boiling points greater than 180 F. The process has at least three steps. The highly paraffinic feedstock is dehydrogenated in a dehydrogenation zone to produce an olefinic feedstock. The olefinic feedstock is contacted with an oligomerization catalyst in an oligomerization zone to produce a product having a higher number average molecular weight than the olefinic feedstock. That product is separated into a light byproduct fraction and a heavy product fraction. That heavy product fraction comprises a lube base stock.

As used herein the following terms have the following meanings unless expressly stated to the contrary:

The term "catalytic distillation unit" refers to a distillation unit having, within it, at least one bed of catalyst.

The term "dehydrogenation zone" refers to a reaction zone were dehydrogenation is the predominate reaction. The dehydrogenation may involve the cracking of wax, which provides olefinic products.

The term "heavy product fraction" refers to a heavier fraction of the product from the oligomerization zone, and contains the main product from that zone.

The term "highly paraffinic feedstock" refers to a feedstock comprising at least 50% paraffins.

The term "light byproduct fraction" refers to a lighter fraction of the product from the oligomerization zone, and contains byproduct from that zone. (The light byproduct fraction is lighter than the heavy product fraction.)

The term "light gas fraction" refers to the lightest fraction of the separation of Fischer-Tropsch product. This fraction is sometimes referred to in the literature as a "tail gas fraction."

The term "lube base oil range" refers to materials having initial boiling points of at least 572° F. (300° C.).

The term "lube base stock" refers to hydrocarbons in the lube base oil range that have acceptable viscosity index and viscosity for use in making finished lubes. Lube base stocks are mixed with additives to form finished lubes.

The term "middle fraction" refers to a fraction of the separation of Fischer-Tropsch product that is heavier than the lightest fraction and lighter than the heaviest fraction. This fraction is sometimes referred to in the literature as a "condensate fraction."

The term "olefinic feedstock" refers to a feedstock having at least some olefins.

The term "oligomerization catalyst" refers to a catalyst that can promote oligomerization.

The term "oligomerization zone" refers to a reaction zone containing an oligomerization catalyst.

The term "oxidation stability" refers to a test measuring resistance to oxidation by means of a Dornte-type oxygen absorption apparatus (R. W. Dornte "Oxidation of White Oils," *Industrial and Engineering Chemistry*, Vol. 28:26, 1936). Normally, the conditions are one atmosphere of pure oxygen at 340° F., and one reports the hours to absorption of 1000 milliliters of oxygen by 100 g. of oil. In the Oxidator BN test, 0.8 milliliters of catalyst is used per 100 grams of oil and an additive package is included in the oil. The catalyst is a mixture of soluble metal-naphthenates simulating the average metal analysis of used crankcase oil. The additive package is 80 millimoles of zinc bis-polypropylene phenyl dithio phosphate per 100 grams of oil. The Oxidator BN measures the response of a lubricating oil in a simulated application.

The term "skeletal isomerization" refers to changing the structure of a molecule such as to increase its degree of branching without changing its molecular weight.

The term "viscosity index" refers to the measurement defined by D 2270-93.

The term "wax fraction" refers to the heaviest fraction of the separation of Fischer-Tropsch product. That fraction is called a wax fraction because it usually contains a high degree of waxy material.

The term "with boiling points" refers to streams wherein at least 80% of the stream has the given boiling points. For instance, "a highly paraffinic feedstock having boiling points greater than 180° F." refers a highly paraffinic feedstock wherein at least 80% of that feedstock has boiling points greater than 180° F.

Unless otherwise specified, all percentages are in weight percent and all molecular weights are number average molecular weights.

As defined above, the "highly paraffinic feedstock" refers to a feedstock comprising at least 50% paraffins, more preferably, at least 75% by weight paraffins. The highly paraffinic feedstock has boiling points greater than 180° F., preferably greater than 258° F., more preferably between 258° and 1100° F., and most preferably between 258° and 650° F. Boiling points greater than 258° F. are preferred because they provide, by oligomerization, a lube oil using a minimum number of monomers. This simplifies the process and avoids excessive branching in the lube oil (excessive branching reduces the viscosity index). Since a typical lube oil has an initial boiling point above 650° F., oligomerizing molecules which are already in the lube oil boiling range is not usually as preferred as producing lube oil from lower boiling components.

High paraffinicity is preferred to avoid cyclic molecules, such as aromatics and naphthenes, which have lower viscosity indexes and oxidation stabilities.

In one embodiment, the highly paraffinic feedstock is produced by a Fischer-Tropsch process. The Fischer-Tropsch products can be separated into at least a light gas fraction, a middle fraction, and a wax fraction. The middle fraction is preferably used for the highly paraffinic feedstock. However, either the wax fraction alone or the combination of the wax fraction and a portion of the middle fraction can be thermally cracked and at least a portion of that cracked product can be sent to the oligomerization zone.

Preferred olefinic feedstocks are derived, in whole or in part, from Fischer-Tropsch synthesis. Fischer-Tropsch synthesis may be effected in a fixed bed, in a slurry bed, or in a fluidized bed reactor. The Fischer-Tropsch reaction conditions may include using a reaction temperature of between 190° C. and 340° C., with the actual reaction temperature being largely determined by the reactor configuration. Thus, when a fluidized bed reactor is used, the reaction temperature is preferably between 300° C. and 340° C.; when a fixed bed reactor is used, the reaction temperature is preferably between 200° C. and 250° C.; and when a slurry bed reactor is used, the reaction temperature is preferably between 190° C. and 270° C.

An inlet synthesis gas pressure to the Fischer-Tropsch reactor of between 1 and 50 bar, preferably between 15 and 50 bar, may be used. The synthesis gas may have a $H_2$:CO molar ratio, in the fresh feed, of 1.5:1 to 2.5:1, preferably 1.8:1 to 2.2:1. The synthesis gas typically includes 0.1 wppm of sulfur or less. A gas recycle may optionally be employed to the reaction stage, and the ratio of the gas recycle rate to the fresh synthesis gas feed rate, on a molar basis, may then be between 1:1 and 3:1, preferably between 1.5:1 and 2.5:1. A space velocity, in $m^3$ (kg catalyst)$^{-1}$hour$^{-1}$, of from 1 to 20, preferably from 8 to 12, may be used in the reaction stage.

In principle, an iron-based, a cobalt-based or an iron/cobalt-based Fischer-Tropsch catalyst can be used in the Fischer-Tropsch reaction stage. The iron-based Fischer-Tropsch catalyst may include iron and/or iron oxides which have been precipitated or fused. However, iron and/or iron oxides which have been sintered, cemented, or impregnated onto a suitable support can also be used. The iron should be reduced to metallic Fe before the Fischer-Tropsch synthesis. The iron-based catalyst may contain various levels of promoters, the role of which may be to alter one or more of the activity, the stability, and the selectivity of the final catalyst.

Preferred promoters are those influencing the surface area of the reduced iron ("structural promoters"), and these include oxides or metals of Mn, Ti, Mg, Cr, Ca, Si, Al, or Cu or combinations thereof.

The products from Fischer-Tropsch reactions generally include a gaseous reaction product and a liquid reaction product. The gaseous reaction product includes hydrocarbons boiling below about 650° F. (e.g., tail gases through middle distillates). The liquid reaction product (the wax fraction) includes hydrocarbons boiling above about 650° F. (e.g., vacuum gas oil through heavy paraffins).

The minus 650° F. product can be separated into a light gas fraction and a middle fraction, using, for example, a high pressure and/or lower temperature vapor-liquid separator or low pressure separators or a combination of separators. The middle fraction typically includes about $C_5$ to $C_{20}$ normal paraffins and higher boiling hydrocarbons.

The fraction boiling above about 650° F. (the wax fraction) primarily contains $C_{20}$ to $C_{50}$ linear hydrocarbons (paraffins, olefins and alcohols) with relatively small amounts of higher boiling branched hydrocarbons.

The presence of sulfur, nitrogen, halogen, selenium, phosphorus, and arsenic contaminants in the feedstock is undesirable. For this reason, it is preferred to remove sulfur and other contaminants from the feed before performing the dehydrogenation and oligomerization steps. Means for removing these contaminants are well known to those of skill in the art. For example, hydrotreating and adsorption on ZnO guardbeds are preferred for removing sulfur impurities. Preferably, the sulfur content is reduced below 100 ppm, most preferably below 50 ppm. Nitrogen can be removed by hydrotreating. The product nitrogen content should be below 50 ppm, preferably below 10 ppm. Means for removing other contaminants are well known to those of skill in the art.

In one embodiment, any methane produced by the reaction is recovered and converted to synthesis gas for recycling in the process. In some embodiments, the product stream may contain a relatively large amount of olefins that can be hydrogenated following the Fischer-Tropsch chemistry.

Preferably, the highly paraffinic feedstock is purified in a purification zone (e.g., hydrotreated in a hydrotreating zone) to remove oxygenates and other impurities. Such hydrotreating zones are well known in the industry. Other treatments useful for removing oxygen and other impurities include, but are not limited to, adsorption (e.g., with an acid clay), and extraction.

Preferably, the highly paraffinic feedstock is also dehydrated and decarboxylated to convert alcohols or acids which may be present to olefins. Dehydroxylation and decarboxylation of alcohols and acids are well known. Both reactions can be effected by processing the feedstock over a catalyst, typically alumina, under moderate temperatures and pressures. The reaction of linear alcohols yields predominantly linear olefins and, and acids yield paraffins and carbon dioxide. The water and carbon dioxide can be removed from the reaction mixture, for example, by distillation.

Hydrogenation catalysts can be used for the purification. For example, a noble metal from Group VIIIA according to the 1975, rules of the International Union of Pure and Applied Chemistry, such as platinum or palladium on an alumina or siliceous matrix, or unsulfided Group VIIIA and Group VIB, such as nickel-molybdenum or nickel-tin on an alumina or siliceous matrix, is a suitable catalyst. U.S. Pat. No. 3,852,207 to Stangeland et al. ("Production of Stable Lubricating Oils By Sequential Hydrocracking and Hydrogenation") describes a suitable noble metal catalyst and mild conditions. Other suitable catalysts are detailed, for example, in U.S. Pat. No. 4,157,294 to Iwao, et al. ("Method of Preparing Base Stocks For Lubricating Oil"), and U.S. Pat. No. 3,904,513 to Fischer et al. ("Hydrofinishing or Petroleum"). The non-noble metal (such as nickel-molybdenum) hydrogenation metal are usually present in the final catalyst composition as oxides, or more preferably or possibly, as sulfides when such compounds are readily formed from the particular metal involved. Preferred non-noble metal overall catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. The noble metal (such as platinum) catalysts contain in excess of 0.01% metal, preferably between 0.1 and 1.0% metal. Combinations of noble metals may also be used, such as mixtures of platinum and palladium.

The hydrogenation components can be incorporated into the overall catalyst composition by any one of numerous procedures. The hydrogenation components can be added to matrix component by co-mulling, impregnation, or ion exchange and the Group VI components, i.e.; molybdenum and tungsten can be combined with the refractory oxide by impregnation, co-mulling or co-precipitation. Although these components can be combined with the catalyst matrix as the sulfides, that is generally not the case. They are usually added as a metal salt, which can be thermally converted to the corresponding oxide in an oxidizing atmosphere or reduced to the metal with hydrogen or other reducing agent. If necessary, the non-noble metal composition can then be sulfided by reaction with a sulfur donor such as carbon bisulfide, hydrogen sulfide, hydrocarbon thiols, elemental sulfur, and the like.

The matrix component can be of many types including some that have acidic catalytic activity. Ones that have activity include amorphous silica-alumina or may be a zeolitic or non-zeolitic crystalline molecular sieve. Examples of suitable matix molecular sieves include zeolite Y, zeolite X and the so called ultra stable zeolite Y and high structural silica:alumina ratio zeolite Y such as for example described in U.S. Pat. No. 4,401,556 to Bezman, et al. ("Midbarrel Hydrocracking"), U.S. Pat. No. 4,820,402 to Partridge, et al., ("Hydrocracking Process With Improved Distillate Selectivity With High Silica Large Pore Zeolites"), and U.S. Pat. No. 5,059,567 to Listen, et al. ("Process For The Preparation of A Modified Zeolite"). Small crystal size zeolite Y, such as described in U.S. Pat. No. 5,073,530 to Bezman, et al. ("Hydrocracking Catalyst And Process") can also be used. Non-zeolitic molecular sieves which can be used include, for example silicoaluminophosphates (SAPO), ferroaluminophosphate, titanium aluminophosphate and the various ELAPO molecular sieves described in U.S. Pat. No. 4,913,799 to Gortsema, et al. ("Hydrocracking Catalysts And Processes Employing Non-Zeolitic Molecular Sieves") and the references cited therein. Details regarding the preparation of various non-zeolite molecular sieves can be found in U.S. Pat. No. 5,114,563 to Lok, et al. ("Hydrocarbon Conversions Using Catalysts Silicoaluminophosphates"); and in U.S. Pat. No. 4,913,799. Mesoporous molecular sieves can also be included, for example the M41S family of materials, MCM-41 (U.S. Pat. No. 5,246,689 to Beck, et al. ("Synthetic Porous Crystalline Material Its Synthesis And Use"), U.S. Pat. No. 5,198,203 to Kresge, et al. ("Synthetic Mesoporous Crystalline Material"), and U.S. Pat. No. 5,334,368 to Beck, et al. ("Synthesis of Mesoporous Oxide")), and MCM-48.

Suitable matrix materials may also include synthetic or natural substances as well as inorganic materials such as clay, silica and/or metal oxides such as silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia zirconia. The latter may be either naturally occurring or in the form of gelatinous precipitates or gels including mixtures of silica and metal oxides naturally occurring clays which can be composited with the catalyst include those of the montmorillonite and kaolin families. These clays can be used in the raw state as originally mined or initially subjected to calumniation, acid treatment, or chemical modification.

Furthermore more than one catalyst type may be used in the reactor. The different catalyst types can be separated into layers or mixed.

Typical hydrotreating conditions vary over a wide range. In general, the overall LHSV is about 0.25 to 2.0, preferably about 0.5 to 1.0. The hydrogen partial pressure is greater than 200 psia, preferably ranging from about 500 psia to about 2000 psia. Hydrogen recirculation rates are typically greater than 50 SCF/Bbl, and are preferably between 1000 and 5000 SCF/Bbl. Temperatures range from about 300° F. to about 750° F., preferably ranging from 450° F. to 600° F.

If it is desirable to introduce skeletal isomerization during the paraffinic feedstock hydrotreating step, or during the hydrotreating of the product from the oligomerization reactor, or during the hydrotreating of the final lube base oil range hydrocarbons, the matrix of the catalyst is chosen to facilitate this reaction. Detailed descriptions of catalysts that do this reaction are shown in U.S. Pat. Nos. 5,282,958; 5,246,566; 5,135,638 and 5,082,986 referred to in the Background of the Invention section. A molecular sieve is used as one component in the matrix. The sieve has pores of less than 7.1 Å, preferably less than 6.5 Å; and having at least one pore diameter greater than 4.8 Å, and having a crystal size no more than about 0.5 microns. The catalyst is further characterized in that it has sufficient acidity to convert at least 50% of hexadecane at 370° C., and exhibits a 40 or greater isomerization selectivity ratio as defined in U.S. Pat. No. 5,282,958 at 96% hexadecane conversion. Specific examples of molecular sieves which satisfy these requirements are ZSM-12, ZSM-21, ZSM-22, ZSM-23, ZSM-35, ZSM-38, ZSM-48, ZSM-57, SSZ-32, SSZ-35, Ferrierite, L-type zeolite, SAPO-11, SAPO-31, SAPO-41, MAPO-11 and MAPO-31.

U.S. Pat. Nos. 3,852,207; 3,904,513; 4,157,294; 4,401,556; 4,820,402; 4,913,799; 5,059,567; 5,073,530; 5,114,563; 5,198,203; 5,246,689; and 5,334,368 are hereby incorporated by reference for all purposes.

An adsorption step may be employed to remove nitrogenous species from the feed. It is preferred that the concentration of organic nitrogen in the feed to the oligomerization step in the present process be less than about 40 ppm, preferably less than about 20 ppm. Suitable adsorbents to remove the nitrogen compounds include heterogeneous acid materials such as acidic clays, molecular sieves, and ion exchange resins. Such materials are described in U.S. Pat. No. 4,657,661 to Miller ("Process For Improving The Storage Stability And Bulk Oxidation Stability Of Lube Base Stocks Derived From Bright Stock"), hereby incorporated by reference for all purposes.

In the dehydrogenation zone, the highly paraffinic feedstock is dehydrogenated to produce an olefinic feedstock. Dehydrogenation processes known in the art generally have employed catalysts which comprise a noble metal, usually Pt, supported on a non-acid support, typically alumina, silica, or non-acidic alumino silicate. The temperature at which paraffin dehydrogenation is normally carried out is in a range from 350° to 650° C. (preferably from 400° to 550° C.). The process is usually carried out at atmospheric pressure, although it is possible to operate at a pressure of several atmospheres, for example up to 10 atmospheres.

The linear paraffins are generally fed at a rate of from 0.001 to 100 volumes (calculated as a liquid) per hour for each volume of catalyst. Moreover, since the dehydrogenation reaction takes place in the presence of hydrogen gas, it is convenient to maintain the molar ratio of hydrogen to linear paraffin in the feed mixture at a value of from 1:1 to 50:1.

Skeletal isomerization can be carried out simultaneously with dehydrogenation by using a catalyst with an acidic isomerization function in combination with a catalyst with a dehydrogenation function. These catalytic functions can be on separate particles with the particles either mixed or in layers, or on the same particle. Examples of catalysts which carry out both isomerization and dehydrogenation include Group VIII metals on acidic amorphous supports, such as taught in U.S. Pat. No. 5,866,746 to Didillion, et al. ("Catalytic Dehydroisomerization of $C_4$–$C_5$ N-Paraffins"), and metals on zeolitic supports, such as taught in U.S. Pat. No. 5,198,597 to O'Young, et al. ("Bimetallic Catalysts For Dehydroisomerization of N-Butane to Isobutene").

In order to reduce or eliminate the amount of diolefins produced or other undesired byproducts the reaction conversion to olefins in the olefinic feedstock should preferably not exceed 50% and more preferably should not exceed 30% based on the linear hydrocarbon content of the feed. Preferably, the minimum conversion is at least 10% and more preferably at least 20%.

If skeletal isomerization is not induced during hydrotreatment of the highly paraffinic feedstock or during dehydrogenation, these olefins inherently are usually predominately internal olefins.

Skeletal isomerization of the paraffinic feedstock, of intermediate olefin steams, or of the final product can be used to control the pour and cloud point of the final product to the desired value. Preferably, this skeletal isomerization is induced prior to the oligomerization zone.

Skeletal isomerization is preferred before oligomerization because, if isomerization is required to meet pour point requirements, it is easier to isomerize the lower molecular weight components to the oligomerization step than the high molecular weight oligomer. This will result in a higher yield of lube oil, since the cracking and yield loss trying to isomerize the oligomer can thus be avoided.

If it is desired to induce skeletal isomerization of the olefinic intermediates (either the product from the paraffin dehydrogenation step, or the oligomerization step), U.S. Pat. No. 5,741,759 to Gee, et al. ("Skeletally Isomerized Linear Olefins") and U.S. Pat. No. 5,965,783 to Gee, et al. ("Process For Isomerizing Olefins") describe catalysts and process conditions to do this. Molecular sieves as defined above in the paraffin skeletal isomerization step may be used as catalyst, however metals, such as noble metals, are excluded from the catalyst formulation. The molecular sieve is frequently composited with a binder to form an extrudate, sphere, or pellet. Temperatures used to skeletally isomerize the olefins are between 100° and 400° C., the WHSV is between 0.2 and 10, and the pressure is typically below 500 psig, preferably below 100 psig.

Preferably, diolefins produced during the dehydrogenation are removed by known adsorption processes or selective hydrogenation processes that selectively hydrogenate diolefins to monoolefins without significantly hydrogenating monoolefins. Suitable selective hydrogenation processes for hydrotreating diolefins to monoolefins without hydrogenating monoolefins are, for example, described in U.S. Pat. No. 4,523,045 to Vora ("Process For Converting Paraffins To Olefins"); in U.S. Pat. No. 4,523,048 to Vora ("Process For The Selective Production of Alkylbenzene"); and U.S. Pat. No. 5,012,021 to Vora, et al. ("Process For The Production of AlkylAromatic Hydrocarbons Using Solid Catalysts"). If desired, branched hydrocarbons may be removed before or after the dehydrogenation process, typically by adsorption.

U.S. Pat. No. 4,523,045; 4,523,048; 5,012,021; 5,198,597; 5,741,759; 5,866,746; and 5,965,783 are hereby incorporated by reference for all purposes.

The olefinic feedstock produced in the dehydrogenation zone is contacted with an oligomerization catalyst in an oligomerization zone to produce a product having a higher number average molecular weight than initial feedstock. Preferably, the product has a higher number average molecular weight at least 10% higher than the initial feedstock, more preferably at least 20% higher than the initial feedstock. Since the oligomerization catalyst can also promote skeletal isomerization of olefins, both oligomerization and skeletal isomerization can occur in the same process step.

Conditions for this reaction in the oligomerization zone are between room temperature and 400° F., from 0.1 to 3 LHSV, and from 0 to 500 psig. Catalysts for oligomerization can be virtually any acidic material including zeolites, clays, resins, $BF_3$ complexes, HF, $H_2SO_4$, $AlCl_3$, ionic liquids (preferably acidic ionic liquids), superacids, etc. Preferably, the catalyst is a Group VIII metal on an inorganic oxide support, more preferably a Group VIII metal on a zeolite support. Zeolites are preferred because of their resistance to fouling and ease of regeneration. In one embodiment, the catalyst is nickel on ZSM-5.

Oligomerization of olefins is disclosed in U.S. Pat. Nos. 4,417,088, 4,542,251, and 5,965,783 described in the Background of the Invention section.

The oligomerization of olefins using ionic liquids is disclosed in U.S. Pat. No. 5,550,304 to Chauvin, et al. ("Nickel-Containing Composition For Catalysis And Olefin Dimerisation And Oligomerisation Process") and U.S. Pat. No. 5,502,018 to Chauvin, et al. ("Nickel-Containing Composition For Catalysis And Olefin Dimerisation And Oligomerisation Process"), which are both hereby incorporated by reference for all purposes.

In one embodiment, the oligomerization zone is located within a catalytic distillation unit used to both produce the product and separate the product into a light byproduct fraction and a heavy product fraction. This is done to take advantage of refinery capacity made surplus by prohibitions against TAME and MTBE in gasoline. In that embodiment, the olefinic feedstock can also be contacted with an oligomerization catalyst in a fixed bed prior to the catalytic distillation unit. Preferably, portions of the light byproduct fraction and the heavy product fraction are refluxed to the catalytic distillation unit. In that embodiment, the olefinic feedstock can be contacted with an oligomerization catalyst within the catalytic distillation unit or within a fixed bed.

If desired, skeletal isomerization can be induced on the product from the oligomerization zone, using a matrix of the catalyst chosen to facilitate this reaction, as described above in the "Purification of the Feedstock By Hydrotreatment" section.

The present invention involves not only the process where one dehydrogenates a highly paraffinic feedstock to produce an olefinic feedstock, then contacts that olefinic feedstock with an oligomerization catalyst in an oligomerization zone. It also involves the process (and the hydrocarbon in the lube base oil range produced by that process) where one contacts an olefinic feedstock obtained from an alternative source with an oligomerization catalyst if at least a portion of that olefinic feedstock that produced by dehydrogenating a highly paraffinic feedstock having boiling points greater than 180° F., in a dehydrogenation zone.

By "alternative source," we mean that not all of the olefinic feedstock is made in a dehydrogenation zone within the same plant as the oligomerization zone. One possible "alternative source" is an olefinic feedstock obtained from another company, wherein that olefinic feedstock was produced by dehydrogenating a highly paraffinic feedstock having boiling points greater than 180° F. in a dehydrogenation zone. Another possible "alternative source" is a mixture of (1) olefinic feedstock produced by dehydrogenating a highly paraffinic feedstock having boiling points greater than 180° F. in a dehydrogenation zone (in the same or different plant as the oligomerization unit) and (2) an olefinic feedstock produced by any other method.

In that embodiment, an olefinic feedstock with an oligomerization catalyst to produce a product having a higher number average molecular weight than the olefinic feedstock, wherein at least a portion of said olefinic feedstock is produced by dehydrogenating a highly paraffinic feedstock, with boiling points greater than 180° F. in a dehydrogenation zone; and separating the product of the oligomerization zone into a light byproduct fraction and a heavy product fraction, wherein said heavy product fraction comprises a lube base stock.

The product of the oligomerization zone is separated into a light byproduct fraction and a heavy product fraction, wherein said heavy product fraction comprises a lube base stock. This separation can be done by conventional separation techniques, such as distillation.

That heavy product fraction includes predominately hydrocarbons in the lube base oil range that have acceptable viscosity index and viscosity for use in making finished lubes (lube base stock). Preferably, the heavy product fraction has a viscosity of greater than 2 cSt at 100° C. and a viscosity index of above 80 (more preferably above 120). A viscosity index of over 120 is preferred over a viscosity of over 80 because the higher VI oil will maintain its viscosity to a greater degree over a range of temperatures (the definition of VI). The higher VI oil will likely have higher oxidation stability. Preferably, the pour point is less than −10° C., more preferably less than −20° C.

If desired, skeletal isomerization can be induced on the heavy product fraction, using a matrix of the catalyst chosen to facilitate this reaction, as described above in the "Purification of the Feedstock By Hydrotreatment" section.

Preferably, at least a portion of the light byproduct fraction is recycled to the dehydrogenation zone. Alternatively, it can be recycled to the purification zone or to the oligomerization zone.

Distillation bottoms can be discarded (e.g., if any solids are present), or they can be kept for subsequent processing.

Preferably, the heavy product fraction is separated into at least one of the following fractions:

a) a light lube base stock fraction having a viscosity of from 2 to 7 cSt at 100° C.;

b) a heavy lube base stock fraction having a viscosity of from 6 to 20 cSt at 100° C.; and c) a bright stock fraction having a viscosity of greater than 180 cSt at 40° C.

The specifications for lube base stocks are defined in the API Interchange Guidelines (API Publication 1509). Group II base stocks have no more than 300 ppm sulfur, have at least 90% saturates, and have viscosity indexes of from 80 to less than 120. Group II base stock constitutes about 10% of the world lube base stock production, and approximately 30% of the U.S. production.

For Group II stocks, preferably the heavy product fraction is separated into at least one of the following fractions:

a) a light lube base stock fraction having a viscosity of from 3 to 6 cSt at 100° C., more preferably from 3.5 to 5 cSt, most preferably from 3.8 to 4.2 cSt;

b) a heavy lube base stock fraction having a viscosity of from 6 to 16 cSt at 100° C., more preferably from 9 to 13 cSt, most preferably from 11 to 12.5 cSt; and c) a bright stock fraction having a viscosity of greater than 180 cSt at 40° C., more preferably greater than 220, most preferably greater than 250 cSt.

Group III base stocks have no more than 300 ppm sulfur, have at least 90% saturates, and have viscosity indexes of 120 or more. Only a small fraction of the lube base stock production in the world is Group III base stock. For these Group III stocks, preferably the heavy product fraction is separated into at least one of the following fractions:

a) a light lube base stock fraction having a viscosity of from 3 to 7 cSt at 100° C., more preferably from 4 to 6 cSt, most preferably from 4.7 to 5.3 cSt;

b) a heavy lube base stock fraction having a viscosity of from 7 to 20 cSt at 100° C., more preferably from 10 to 15 cSt, most preferably from 12 to 13.5 cSt; and c) a bright stock fraction having a viscosity of greater than 180 cSt at 40° C., more preferably greater than 220, most preferably greater than 250 cSt.

The split between the light byproduct fraction and the heavy product fraction can be adjusted, along with the amount of recycle, to control the viscosity grade distribution of lubes products made. In one particularly preferred embodiment, the separation of fractions is adjusted so that the heavy product fraction is mainly bright stock fraction. Substantially the entire light byproduct fraction is recycled either to the dehydrogenation zone or to the oligomerization zone or to both.

Undesired buildup in any of the recycle streams can be managed by taking a bleed from the recycle stream and either using it as fuel oil or blending it into export crude.

Preferably, either the product of the oligomerization zone or the heavy product fraction is hydrofinished to eliminate any remaining olefins. More preferably, the heavy product fraction is hydrogenated to remove any remaining olefins. Typical conditions are between 200° and 600° F., 0.1 to 3 LHSV, and 200 to 3000 psig. Catalysts that do this reaction can be any NiMo supported catalyst or a Group VIII metal on a support. Preferred catalysts are platinum, palladium, or platinum-palladium alloys.

If the product of the oligomerization is hydrofinished, then at least a portion of the light byproduct fraction preferably goes to dehydrogenation zone, or alternatively to the purification zone, or to fuel. If the heavy product fraction is hydrogenated, at least a portion of the light byproduct fraction preferably goes to the dehydrogenation zone, or alternatively to the first purification zone, or to oligomerization zone, or to fuel.

Conventional cloud point reduction processes can be used correct any unacceptable could point. For instance, this can be done either before hydrofinishing in a separate reactor, by isomerization of the olefinic oligomer (e.g., see U.S. Pat. No. 5,082,986 described in the "Background of the Invention" section and U.S. Pat. No. 5,965,783 described in "The Dehydrogenation Reaction" section) or in the same reactor with the hydrofinishing catalyst.

In one embodiment of the present invention, the wax fraction from the Fischer-Tropsch synthesis is hydrocracked. Hydrocracking can be effected by contacting the particular fraction or combination of fractions, with hydrogen in the presence of a suitable hydrocracking catalyst at temperatures in the range of about from 600° to 900° F. (316° to 482° C.) preferably 650° to 850° F. (343° to 454° C.) and pressures in the range about from 200 to 400 psia (13 to 272 atmospheres) preferably 500 to 3000 psia (34 to 204 atmospheres) using space velocities based on the hydrocarbon feedstock of about 0.1 to 10 $hr^{-1}$ preferably 0.25 to 5 $hr^{-1}$. Generally, more severe conditions within these ranges will be used with higher boiling feedstocks and depending on whether gasoline, middle distillate, or lubricating oil is desired as the primary economic product. The hydrocracking step reduces the size of the hydrocarbon molecules, hydrogenates olefin bonds, hydrogenates aromatics, and removes traces of heteroatoms resulting in an improvement in fuel or base oil product quality.

As is well known, the hydrocracking catalysts contain a hydrogenation component and a cracking component. The hydrogenation component is typically a metal or combination of metals selected from Group VIII noble and non-noble metals and Group VIB metals. The noble metals, particularly platinum or palladium, are generally more active but are expensive. Non-noble metals which can be used include molybdenum, tungsten, nickel, cobalt, etc. Where non-noble metals are used it is generally preferred to use a combination of metals, typically at least one Group VIII metal and one Group VIB metal, e.g., nickel-molybdenum, cobalt-molybdenum, nickel-tungsten, and cobalt-tungsten. The non-noble metal hydrogenation metal are usually present in the final catalyst composition as oxides, or more preferably, as sulfides when such compounds are readily formed from the particular metal involved. Preferred non-noble metal overall catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. The sulfide form of these metals is most preferred due to higher activity, selectivity and activity retention.

The hydrogenation components can be incorporated into the overall catalyst composition by any one of numerous procedures. They can be added either to the cracking component or the support or a combination of both. In the alternative, the Group VIII components can be added to the cracking component or matrix component by co-mulling, impregnation, or ion exchange and the Group VI components, i.e.; molybdenum and tungsten can be combined with the refractory oxide by impregnation, co-mulling or co-precipitation. Although these components can be combined with the catalyst support as the sulfides, that is generally not the case. They are usually added as a metal salt, which can be thermally converted to the corresponding oxide in an oxidizing atmosphere or reduced to the metal with hydrogen or other reducing agent. The non-nobel metal composition can then be sulfided by reaction with a sulfur donor such as carbon bisulfide, hydrogen sulfide, hydrocarbon thiols, elemental sulfur, and the like.

The cracking component is an acid catalyst material and may be a material such as amorphous silica-alumina or may be a zeolitic or non-zeolitic crystalline molecular sieve. Examples of suitable hydrocracking molecular sieves include zeolite Y, zeolite X and the so called ultra stable zeolite Y and high structural silica:alumina ratio zeolite Y Non-zeolitic molecular sieves which can be used include, for example silicoaluminophosphates (SAPO), ferroaluminophosphate, titanium aluminophosphate and the various ELAPO molecular sieves . Mesoporous molecular sieves can also be included. These materials are described above in the section "Purification of the Feedstock By Hydrotreatment."

In general amorphous silica-alumina is more selective for middle distillates, e.g., diesel fuel, whereas crystalline molecular sieves are much more active and produce greater amounts of lighter products, e.g., gasoline. The so-called high (structural) silica-alumina ratio ($Si_2O_3$:$Al_2O_3$=about 50) Y zeolites are less active than the conventional zeolite Y but, are more selective for middle distillate and more active than amorphous silica-alumina. The catalyst also typically contains a matrix or binder material resistant to the conditions used in the hydrocracking reaction. Suitable matrix materials include synthetic or natural substances as well as inorganic materials such as clay, silica and/or metal oxides. The latter may be either naturally occurring or in the form of gelatinous precipitates or gels including mixtures of silica and metal oxides naturally occurring clays which can be composited with the catalyst include those of the montmorillonite and kaolin families. These clays can be used in the raw state as originally mined or initially subjected to calumniation, acid treatment or chemical modification.

The catalyst may be composited with a porous matrix material, such as alumina, silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia zirconia. The relative proportions of molecular sieve component and inorganic oxide matrix or binder may vary widely with the molecular sieve content ranging from between 1 to 99, more usually 5 to 80, percent by weight of the composite. The matrix may itself possess catalytic properties generally of an acidic nature, such as for example where amorphous silica-alumina is used as a matrix or binder for a molecular sieve. In general we prefer to use a non-zeolite or low acidic zeolite catalyst, e.g., high structural silica:alumina ratio Y zeolite, as the catalyst where middle distillates is desired as the main commercial product and an acidic zeolite catalyst, e.g., conventional or ultra stabilized Y zeolite, where gasoline is desired as the main commercial product.

Furthermore more than one catalyst type may be used in the reactor. The different catalyst types can be separated into layers or mixed.

EXAMPLES

The invention will be further illustrated by following examples, which set forth particularly advantageous method embodiments. While the Examples are provided to illustrate the present invention, they are not intended to limit it.

Examples one through eight show oligomerization of various feeds with various catalysts.

Example One

Oligomerization of $C_{10}$ and $C_{15-20}$ Cuts $C_{10}$ and $C_{15}$–$C_{20}$ cuts were obtained from a wax thermal cracker. Both streams contained about 88% n-alphaolefins, with the remainder being mostly paraffins and diolefins. A 3:1 mixture of the $C_{15}$–$C_{20}$/$C_{10}$ cuts was prepared, and reacted over a catalyst composed of 1% Zn on ZSM-5 bound with Catapal alumina. Reaction conditions were 300 psig, 450° F., and 0.25 LHSV. At 200 hours onstream, conversion to 700° F+ lube was about 15%. At that point, the catalyst was rejuvenated by stripping with $H_2$ at 800° F. and the run restarted with recycle of 625° F.– material. Per pass conversion to 700° F.+ was 50–60%. Products were hydrogenated over a Ni—Mo on $SiO_2$-$Al_2O_3$ catalyst at 550° F., 1000 psig, 1 LHSV, and 3600 SCF/bbl $H_2$, and then fractionated by distillation into a 700°–800° F. fraction (47 LV% of the 700° F.+, and a 800° F.+ fraction (53 LV %). Properties are shown below.

| Fraction | 700–800° F. | 800° F.+ |
|---|---|---|
| Pour Point, ° C. | −15 | −9 |
| Viscosity, 40° C., cSt | 11.21 | 49.98 |
| Viscosity, 100° C., cSt | 2.97 | 8.41 |
| VI | 120 | 144 |
| Oxidator BN, hr | 20+ | 20+ |

Example Two

Oligomerization of $C_{15-20}$ Cut

The catalyst of Example One was rejuvenated as described in Example One, and used to oligomerize the $C_{15}$–$C_{20}$ cut at 300 psig, 450° F., and 0.25 LHSV, with a recycle ratio of 0.9 and a 33% 625 F– bleed. Per pass conversion to 700° F.+ was 25%. Product properties, after hydrogenation as in Example 1, were:

| | |
|---|---|
| Pour Point, ° C. | +1 |
| Viscosity, 40° C., cSt | 30.80 |
| Viscosity, 100° C., cSt | 5.90 |
| VI | 139 |
| Oxidator BN, hr | 20+ |

Example Three

Oligomerization of $C_{10}$ Cut

The catalyst of Example Two was rejuvenated as described in Example One, and used to oligomerize the $C_{10}$ cut at 300 psig, 450° F., and 0.25 LHSV, with a recycle ratio of 0.9 and a 33% 625° F.– bleed. Per pass conversion to 700° F.+ was 12%. Product properties, after hydrogenation as in Example 1, were:

| | |
|---|---|
| Pour Point, ° C. | −43 |
| Viscosity, 40° C., cSt | 23.09 |
| 100° C., cSt | 4.329 |
| VI | 90 |

Example Four

Oligomerization of 1-Decene

1% $Et_3Al_2Cl_3$ was added to Ni-ZSM-5 (1.3% Ni, 35% Catapal alumina binder, 80 $SiO_2/Al_2O_3$ mole ratio in the zeolite). Addition was by running an $Et_3Al_2Cl_3$-hexane solution over the catalyst at 400° F. 1-Decene was fed at 300 psig, 350° F., and 0.33 LHSV. Conversion to 700° F.+ over a 325-hour run was about 36%. The product was then hydrofinished over a 0.8% Pd on SiO2—$Al_2O_3$ catalyst at 425° F., 1800 psig, 1 LHSV, and 2400 SCF/bbl $H_2$. The product boiling point distribution was as follows:

| Yield, | Wt % |
|---|---|
| 300° F.– | 2.6 |
| 300°–350° F. | 16.0 |
| 350°–550° F. | 10.4 |
| 550°–700° F. | 35.0 |

-continued

| Yield, | Wt % |
|---|---|
| 700°–950° F. | 14.7 |
| 950° F. + 3.8 | |

A 740° F.+ fraction and a 800°–900° F. fraction were evaluated. The properties are shown below.

| Fraction | 740° F.+ | 800°–900° F. |
|---|---|---|
| Density, g/cc | 0.8314 | 0.8305 |
| Viscosity, cSt at | | |
| −18 C. | 1,381 | 1,063 |
| −40 C. | 16,353 | 13,534 |
| 40 C. | 32.90 | 29.50 |
| 100 C. | 5.650 | 5.208 |
| VI | 111 | 107 |
| Pour Point, ° C. | −53 | −53 |
| Color, ASTM | <0.5 | <0.5 |
| Bromine No. | 1.1 | 5.35 |
| Evaporation at 6.5 Hr/204° C., D 972, % | 16.59 | 13.67 |
| Appearance at Day 0 | Light Floc. | Light Floc. |
| Appearance at Day 14 | Light Floc. | Light Floc. |
| Oxidator BN, hr | 14.7 | 15.5 |

Example Five

Oligomerization of 1-Decene

The $Et_3Al_2Cl_3$ level on the catalyst of Example Four was increased to 6 wt %, and the 1 -decene feed restarted at the same conditions as in Example Four. Conversion to 700° F.+ was 63.4%. The product boiling point distribution was as follows:

| Yield, | Wt. % |
|---|---|
| 300° F.− | 3.0 |
| 300°–350° F. | 7.9 |
| 350°–550° F. | 7.2 |
| 550°–700° F. | 18.5 |
| 700°–950° F. | 26.3 |
| 950° F.+ | 23.4 |

Example Six

Catalyst Screening for Olefin Oligomerization Using 1-Decene

A series of catalysts were evaluated for olefin oligomerization using stirred batch reactors with 1-decene as the test olefin. SAPO-11 was prepared according to patent literature. Acid clays were samples obtained from the commercial manufacturer. The pillared clays were made by pillaring monmorillonite clays with aluminum chlorhydrol solutions according to literature procedures. ETS-10 was prepared according to patent and literature examples and was ammonium-exchanged and calcined. It was an essentially non-acidic material. Al-MCM-41 was prepared according to Mobil patent examples. The $SiO_2/Al_2O_3$ was made by spray drying a co-gelled mixture made from $SiO_2$ and $Al_2O_3$ precursor compounds.

Catalysts were weighed into the reactor, which was then sealed. After drying the catalyst at 150° C. for 18 hours, 1-decene feed was added by syringe under a flow of dry nitrogen. The contents of the reactor were then stirred magnetically and heated to 150° C. The ratio of 1-decene feed to catalyst and the reaction times are given in Table 1. After the desired reaction time, the reactors were cooled and the products analyzed by gas chromatography. For each test, mole % decene conversion and dimer selectivity are shown. Dimer selectivity is defined as:

$$100 \times \text{Weight Dimer Formed}/\text{Weight 1-Decene Reacted}$$

The results show that a number of acidic oxide materials give moderate to high olefin dimerization selectivity. The other products formed are decene isomers. It is understood that results will be somewhat different when carried out at different olefin/catalyst ration, different reaction temperatures, and different reaction times. It is also understood that results obtained in a fixed bed constant flow system may be different that those obtained in batch reactions with the same catalyst. Nonetheless, these batch reaction results can suggest catalysts that will be effective in forming olefin oligomers.

TABLE 1

| Catalyst | Catalyst Description | Rxn Time, hrs | Olefin/Cat Ratio g/g | Olefin Conv., mole % | Dimer Select., % | Pore Size |
|---|---|---|---|---|---|---|
| SAPO-11 | Silicoaluminophosphate | 19 | 1.5 | 96.0 | 42.1 | 10MR (intermediate) |
| SAPO-11 | Silicoaluminophosphate | 1 | 1.5 | 97.6 | 26.8 | 10MR (int.) |
| SAPO-11 | Silicoaluminophosphate | 4 | 1.5 | 83.1 | 28.3 | 10MR (int.) |
| SAPO-11 | Silicoaluminophosphate | 8 | 1.5 | 83.6 | 39.7 | 10MR (int.) |
| SAPO-11 | Silicoaluminophosphate | 12 | 1.5 | 85.2 | 37.2 | 10MR (int.) |
| SAPO-11 | Silicoaluminophosphate | 3 | 1.5 | 82.2 | 38.8 | 10MR (int.) |
| Acid Clay | Süd Chemie Tonsil COG | 24 | 3.0 | 92.7 | 58.5 | unknown |
| Acid Clay | Süd Chemie Tonsil C0614G | 24 | 3.0 | 97.0 | 58.3 | unknown |
| Acid Clay | Harshaw F24 | 24 | 3.0 | 99.3 | 40.5 | unknown |
| Pillared Clay | alumina pillared acid-leached Volclay montmorillonite clay | 24 | 3.0 | 98.5 | 64.5 | unknown |

TABLE 1-continued

| Catalyst | Catalyst Description | Rxn Time, hrs | Olefin/Cat Ratio g/g | Olefin Conv., mole % | Dimer Select., % | Pore Size |
|---|---|---|---|---|---|---|
| Pillared Clay | alumina pillared acid-leached Southern Clay Products montmorillo nite clay | 24 | 3.0 | 99.3 | 61.3 | unknown |
| ETS-10 | Engelhard Titanosilicate | 22 | 3.0 | 2.4 | 56.8 | 12 MR |
| Al-MCM-41 | Mesoporous Aluminosilicate | 24 | 25.2 | 74.8 | 55.8 | Ultra Large Pore, 25 Anst. |
| MCM-22 | Alumino silicate | 24 | 25.2 | 79.1 | 61.1 | 10 MR, 12 MR |
| $SiO_2/Al_2O_3$ | Cogel | 22 | 3.0 | 76.7 | 50.0 | Ultra Large Pore, mesoporous |

int. = intermediate

The non-acidic ETS-10 showed low conversion, indicating the importance of acid components in the catalyst.

Example Seven

Oligomerization of $C_{20-24}$ Olefins Over an Acidic Ionic Liquid

A commercial sample of $C_{20-24}$ Normal Alpha Olefin from Chevron Chemical Co. was converted to a substantially linear internal olfin by isomerization over $Fe(CO)_5$ supplied by Dixie Chemical Co. This is in simulation of the internal olefins that would be generated by dehydrogenation of the corresponding $C_{20-24}$ paraffin.

An acidic chloroaluminate ionic liquid was prepared according to a literature method. 1-Ethyl-3-methylimidazolium chloride and aluminum trichloride were purchased from Aldrich Chemical Company and used as received. In a dry box, two equivalents of solid aluminum trichloride were added in small portions to one equivalent of solid 1-ethyl-3-methylimidazolium chloride. As the addition proceeded, heat was evolved and the solids melted together and became fluid. After stirring at ambient temperature overnight, the liquid was filtered, giving a light brown liquid catalyst.

In four experiments roughly two parts of internal olefin and one part (by volume) of the acidic chloroaluminate ionic liquid were mixed at room temperature and 65° C. for one hour and four hours in small glass vessels. The organic phase was analyzed by a high temperature simulated distillation chromatograph to determine the boiling range of the products. Material in the lube boiling range consisting of dimers, trimers, tetramers and higher oligomers (material boiling above about 1200° F.) were observed in all four experiments.

Example Eight

Oligomerization of $C_{20-24}$ Olefins Over an Acidic Clay

The internal $C_{20-24}$ olefin of the previous example was oligomerized over an acid clay. The acidic clay was Harshaw F24 clay.

The olefin was contacted with the acidic clay at 180° C. in a two liter three-necked round bottom flask equipped with a reflux condenser and a paddle stirrer. Heating was continued for about six hours.

The unreacted $C_{20-24}$ olefin was separated from the product mixture by distillation. The lube fraction was hydrogenated at 70 psig and room temperature using a 10 wt % Pd on carbon catalyst. Little hydrogen was consumed but the product became water white and clear. Analysis of the product by simulated distillation showed that the majority boiled from ~850° to ~1030° F., with a smaller amounts boiling range from ~1030° to ~1150°. Even smaller amounts boiled higher 1200° F. The viscometric properties of the hydrogenated product were found to be:

| | |
|---|---|
| vis at 40° C.: | 54.04 cSt |
| vis at 100° C.: | 9.205 |
| VI: | 152 |
| Pour is | +7° C. |
| Cloud is | +5° C. |

While the pour and cloud points are higher than desirable, they could have been reduced by incorporation of skeletal isomerization.

Examples of Specific Embodiments

In one specific embodiment, as shown in FIG. 1, a highly paraffinic feedstock 5, with boiling points greater than 180° F. and a paraffin content of at least 75%, is produced by a Fischer-Tropsch. Highly paraffinic feedstock 5 is purified in a purification zone 20 to remove oxygen and other impurities to form a purified paraffinic feedstock 25. The purified highly paraffinic feedstock 25 is dehydrogenated in a dehydrogenation zone 40 to produce an olefinic feedstock 45 having from 10% to 50% olefins. The olefinic feedstock 45 is contacted with an oligomerization catalyst in an oligomerization zone 50 to produce a product 55 having a number average molecular weight at least 20% higher than that of the olefinic feedstock 45. The product 55 is hydrofinished in a product hydrofinishing zone 60 to produce a hydrofinished product 65. The hydrofinished product 65 is separated in a product separator 80 into a light byproduct fraction 82 and a heavy product fraction 84. That heavy product fraction 84 is a lube base stock having a viscosity of greater than 4 cSt at 100° C. and a viscosity index of above 80. At least a portion of the light byproduct fraction 82 is recycled to the dehydrogenation zone 40.

Figure 2:
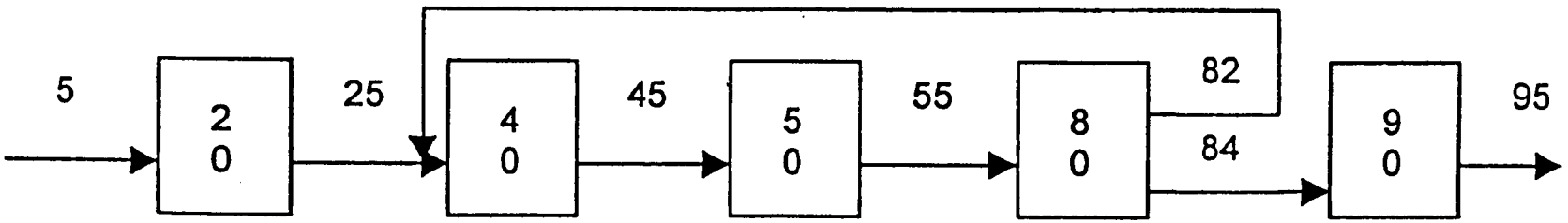
FIG. 2 shows a block diagram of an alternative embodiment of a process for making a lube base stock from a lower molecular weight feedstock.

In a second specific embodiment, as shown in FIG. 2, a highly paraffinic feedstock 5, with boiling points greater than 180° F. and a paraffin content of at least 75%, is produced by a Fischer-Tropsch. Highly paraffinic feedstock 5 is purified in a purification zone 20 to remove oxygen and other impurities to form a purified paraffinic feedstock 25. The purified highly paraffinic feedstock 25 is dehydrogenated in a dehydrogenation zone 40 to produce an olefinic feedstock 45 having from 10% to 50% olefins. The olefinic feedstock 45 is contacted with an oligomerization catalyst in an oligomerization zone 50 to produce a product 55 having a number average molecular weight at least 20% higher than that of the olefinic feedstock 45. The product 55 is separated in a product separator 80 into a light byproduct fraction 82 and a heavy product fraction 84. That heavy product fraction 84 is a lube base stock having a viscosity of greater than 4 cSt at 100° C. and a viscosity index of above 80. That heavy product fraction 84 is hydrofinished in heavy product fraction hydrofinishing zone 90 to produce a hydrofinished heavy product fraction 95. At least a portion of the light byproduct fraction 82 is recycled to the dehydrogenation zone 40.

The difference between the first and second embodiments is that in the first embodiment the product from the oligomerization zone is hydrofinished before the product separator, while in the second embodiment heavy product fraction is hydrofinished.

In a third and fourth embodiment, the production of lube base stock is maximized.

Figure 3:
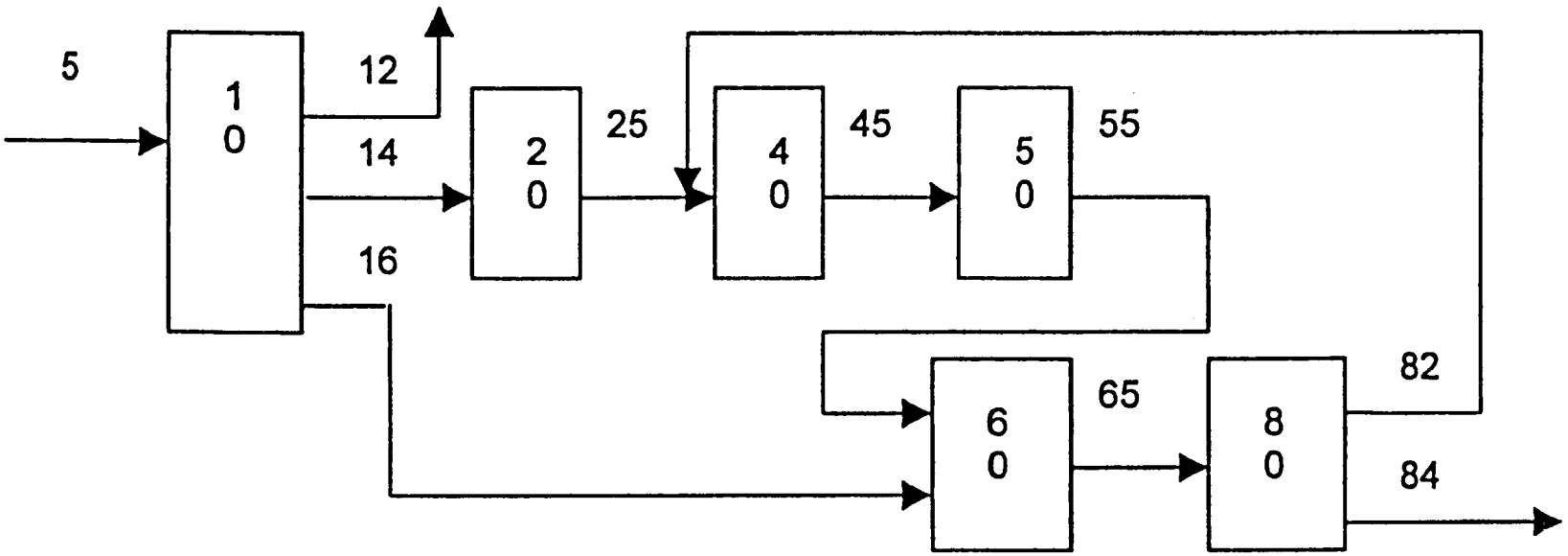
FIG. 3 shows a block diagram of a specific embodiment of a process for making a lube base stock from a lower molecular weight feedstock, wherein the production of bright stock is maximized.

In the third embodiment, as shown in FIG. 3, a highly paraffinic feedstock 5, with boiling points greater than 180° F. and a paraffin content of at least 75%, is produced by a Fischer-Tropsch. The highly paraffinic feedstock 5 is separated in a feedstock separator 10 into a light gas fraction 12, a middle fraction 14 with boiling points greater than 180° F., and a wax fraction 16. The middle fraction 14 is purified in a purification zone 20 to remove oxygen and other impurities to form a purified middle fraction feedstock 25. The purified middle fraction feedstock 25 is dehydrogenated in a dehydrogenation zone 40 to produce an olefinic feedstock 45 having from 10% to 50% olefins. The olefinic feedstock 45 is contacted with an oligomerization catalyst in an oligomerization zone 50 to produce a product 55 having a number average molecular weight at least 20% higher than that of the olefinic feedstock 45. Both the product 55 and the wax fraction 16 are hydrofinished in a product hydrofinishing zone 60 wherein skeletal isomerization is induced to produce an isomerized, hydrofinished product 65. (In alternative embodiments, the product 55 and the wax fraction 16 can be blended prior to going to the product hydrofinishing zone 60, or the product and wax fraction can be hydrofinished in separate hydrofinishing zones.) The isomerized, hydrofinished product 65 is separated in a product separator 80 into a light byproduct fraction 82 and a heavy product fraction 84. That heavy product fraction 84 is a lube base stock having a viscosity of greater than 4 cSt at 100° C., a viscosity index of above 80. Most of the light byproduct fraction 82 is recycled to the dehydrogenation zone 40.

Figure 4:
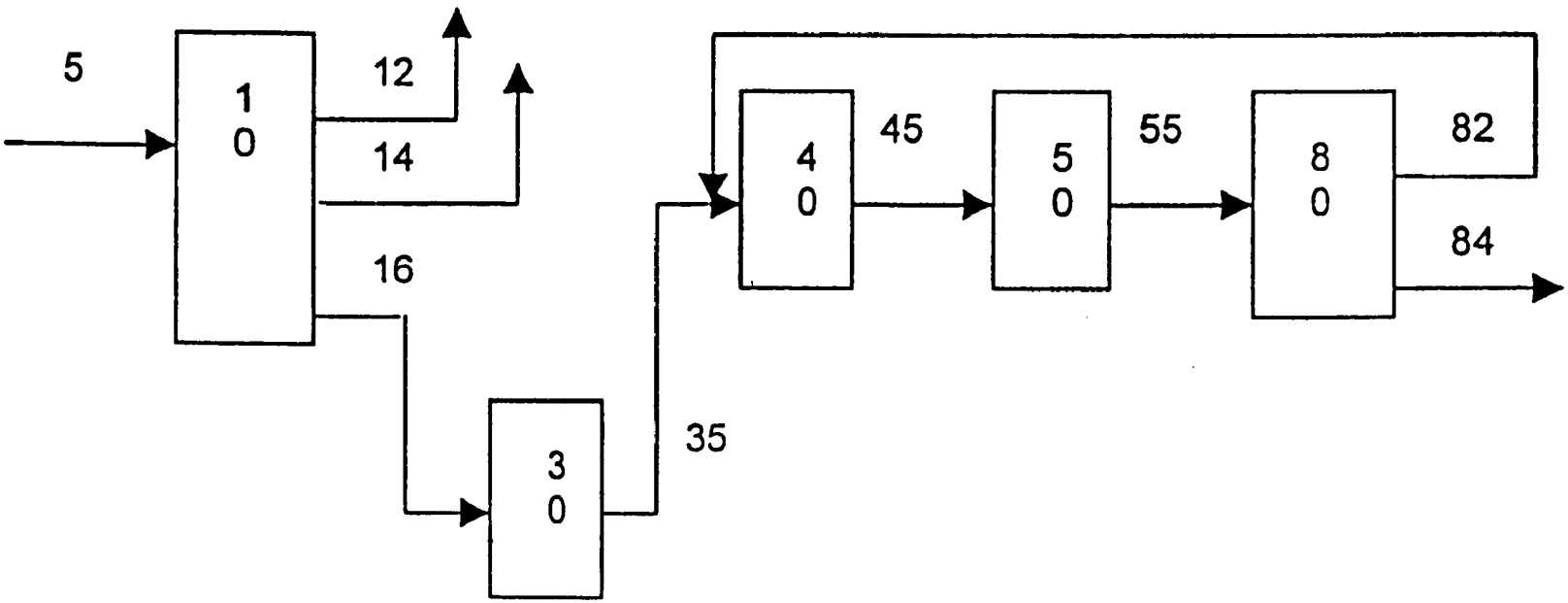
FIG. 4 shows a block diagram of an alternative embodiment of a process for making a lube base stock from a lower molecular weight feedstock, wherein the production of bright stock is maximized.

In the fourth embodiment, as shown in FIG. 4, a highly paraffinic feedstock 5, with boiling points greater than 180° F. and a paraffin content of at least 75%, is produced by a Fischer-Tropsch. The highly paraffinic feedstock 5 is separated in a feedstock separator 10 into a light gas fraction 12, a middle fraction 14 with boiling points greater than 180° F., and a wax fraction 16. The wax fraction 16 is at least partially hydrocracked in hydrocracking zone 30 to produce a cracked waxy feedstock 35. (Preferably, the wax fraction is hydrotreated prior to being hydrocracked in order to permit the hydrocracking zone to operate under milder conditions, which in general favor the formation of heavier products rather than light gases.) The cracked waxy feedstock 35 is dehydrogenated in a dehydrogenation zone 40 to produce an olefinic feedstock 45 having from 10% to 50% olefins. The olefinic feedstock 45 is contacted with an oligomerization catalyst in an oligomerization zone 50 to produce a product 55 having a number average molecular weight at least 20% higher than that of the olefinic feedstock 45. The product 55 is separated in a product separator 80 into a light byproduct fraction 82 and a heavy product fraction 84. That heavy product fraction 84 is a lube base stock having a viscosity of greater than 4 cSt at 100° C. and a viscosity index of above 80. Most of the light byproduct fraction 82 is recycled to the dehydrogenation zone 40.

Although not shown in FIG. 4, the middle fraction can be blended with the cracked wax fraction and the blend can be sent to the dehydrogenation zone, preferably with the middle fraction being isomerized prior to that blending. Also not shown in FIG. 4, either the product 55 or the heavy product fraction 84 should be hydrofinished.

While the present invention has been described with reference to specific embodiments, this application is intended to cover those various changes and substitutions that may be made by those skilled in the art without departing from the spirit and scope of the appended claims.

What is claimed is:

1. A process for making a lube base stock comprising:

(a) dehydrogenating and inducing skeletal isomerization by contacting a highly paraffinic feedstock, with boiling points greater than 180° F., with a catalyst having an acidic component in a dehydrogenation zone to produce an olefinic feedstock;

(b) contacting said olefinic feedstock with an oligomerization catalyst in an oligomerization zone to produce a product having a higher number average molecular weight than the olefinic feedstock; and (c) separating said product of step (b) into a light byproduct fraction and a heavy product fraction, wherein said heavy product fraction comprises a lube base stock.

2. The process of claim 1, wherein said highly paraffinic feedstock has boiling points greater than 258° F.

3. The process of claim 2, wherein said highly paraffinic feedstock has boiling points within the range of from 258° to 650° F.

4. The process of claim 1, wherein said highly paraffinic feedstock has a paraffin content of at least 75%, produced by a Fischer-Tropsch process.

5. The process of claim 4, wherein the product of said Fischer-Tropsch process is separated into a light gas fraction, a middle fraction, and a wax fraction, and wherein said middle fraction forms at least part of the highly paraffinic feedstock.

6. The process of claim 1, wherein said highly paraffinic feedstock is purified to remove oxygen and other impurities.

7. The process of claim 6, wherein said highly paraffinic feedstock is purified by hydrotreating said highly paraffinic feedstock, and wherein further skeletal isomerization is induced while highly paraffinic feedstock is being hydrotreated.

8. The process of claim 1, wherein said olefinic feedstock has from 10% to 50% olefins.

9. The process of claim 1, wherein skeletal isomerization is induced on said olefinic feedstock prior to said oligomerization zone.

10. The process of claim 1, wherein said oligomerization catalyst comprises an inorganic oxide support.

11. The process of claim 10, where said oligomerization catalyst comprises a Group VIII metal on a zeolitic support.

12. The process of claim 1, wherein said oligomerization catalyst is an acidic ionic liquid.

13. The process of claim 1, wherein at least a portion of said light byproduct fraction is recycled to said dehydrogenation zone.

14. The process of claim 1, wherein said heavy product fraction is hydrofinished.

15. The process of claim 1, wherein said heavy products has a viscosity of greater than 2 cSt at 100° C., a viscosity index of at least 80, and a pour point of less than −10° C.

16. The process of claim 1, wherein said heavy product fraction has a viscosity of greater than 2 cSt at 100° C., a viscosity index of at least 120, and a pour point of less than −20° C.

17. The process of claim 1, wherein said heavy product fraction is predominately a bright stock fraction having a viscosity of greater than 180 cSt at 40° C.

18. The process of claim 1, wherein said oligomerization zone is within a catalytic distillation unit, and wherein the product of that zone is separated within said catalytic distillation unit into said light byproduct fraction and said heavy products fraction.

19. The process of claim 18, wherein a portion of said light byproduct fraction is refluxed to said catalytic distillation unit.

20. A hydrocarbon in the lube base oil range produced by the process comprising:

(a) dehydrogenating and inducing skeletal isomerization by contacting a highly paraffinic feedstock, with boiling points greater than 180° F., with a catalyst having an acidic component in a dehydrogenation zone to produce an olefinic feedstock;

(b) contacting said olefinic feedstock with an oligomerization catalyst in an oligomerization zone to produce a product having a higher number average molecular weight than the olefinic feedstock; and (c) separating said product of the oligomerization zone into a light byproduct fraction and a heavy product fraction, wherein said heavy product fraction comprises a lube base stock.

21. A process for making a lube base stock comprising:

(a) contacting an olefinic feedstock with an oligomerization catalyst in an oligomerization zone to produce a product having a higher number average molecular weight than the olefinic feedstock, wherein at least a portion of said olefinic feedstock is produced by dehydrogenating and inducing skeletal isomerization in a highly paraffinic feedstock, with boiling points greater than 180° F., by contacting said paraffinic feestock with a catalyst having an acidic component in a dehydrogenation zone; and (b) separating said product of the oligomerization zone into a light byproduct fraction and a heavy product fraction, wherein said heavy product fraction comprises a lube base stock.

22. A hydrocarbon in the lube base oil range produced by the process according to claim 21.

23. A process for making a lube base stock comprising:

(a) separating a highly paraffinic feedstock into a light gas fraction, a middle fraction with boiling points greater than 180° F., and a wax fraction;

(b) dehydrogenating and inducing skeletal isomerization in said middle fraction by contacting said middle distillate fraction with a catalyst having an acidic component in a dehydrogenation zone to produce an olefinic feedstock;

(c) contacting said olefinic feedstock with an oligomerization catalyst in an oligomerization zone to produce a product having a higher number average molecular weight than the olefinic feedstock;

(d) hydrofinishing said wax fraction and said product of said oligomerization zone;

(e) separating said isomerized products into a light byproduct fraction and a heavy product fraction, wherein said heavy product fraction comprises a lube base stock; and (f) recycling substantially all of said light byproduct fraction to said dehydrogenation zone.

24. A process for making a lube base stock comprising:

(a) separating a highly paraffinic feedstock into a light gas fraction, a middle fraction with boiling points greater than 180° F., and a waxy heavy fraction;

(b) hydrocracking at least part of said wax fraction in a hydrocracking zone to form a cracked wax fraction;

(c) dehydrogenating and inducing skeletal isomerization in said cracked wax fraction by contacting said cracked wax fraction with a catalyst having an acidic component in a dehydrogenation zone to produce an olefinic feedstock;

(d) contacting said olefinic feedstock with an oligomerization catalyst in an oligomerization zone to produce a product having a higher number average molecular weight than the olefinic feedstock;

(e) separating said product of the oligomerization zone into a light byproduct fraction and a heavy product fraction, wherein said heavy product fraction comprises a lube base stock; and (f) recycling substantially all of said light byproduct fraction to said cracking zone.

* * * * *